US006332996B1

(12) United States Patent
Dit Picard et al.

(10) Patent No.: US 6,332,996 B1
(45) **Date of Patent: *Dec. 25, 2001**

(54) PROCESS OF FINISHING AN AIR-LAID WEB AND WEB OBTAINED THEREBY

(75) Inventors: Bernard Louis Dit Picard, Amfreville-la-Campagne (FR); Henri Lesage, Bassevelde (BE); Jean-Louis Neveu, Lery (FR)

(73) Assignee: Georgia-Pacific France, Kunheim (FR)

( * ) Notice: Subject to any disclaimer, the term of this patent is extended or adjusted under 35 U.S.C. 154(b) by 0 days.

This patent is subject to a terminal disclaimer.

(21) Appl. No.: 09/472,979

(22) Filed: Dec. 28, 1999

Related U.S. Application Data

(60) Continuation of application No. 09/188,346, filed on Nov. 9, 1998, now Pat. No. 6,041,701, which is a division of application No. 08/756,527, filed on Nov. 26, 1996, now Pat. No. 5,858,512.

(51) Int. Cl.[7] ..... B29C 59/04; B41F 19/02

(52) U.S. Cl. ..... 264/280; 101/5; 101/6; 264/284

(58) Field of Search ..... 264/280, 284; 101/5, 6

(56) References Cited

U.S. PATENT DOCUMENTS 4,127,637 * 11/1978 Pietreniak et al. .
4,135,024 * 1/1979 Callahan et al. .
4,476,078 * 10/1984 Tao .

* cited by examiner

*Primary Examiner*—Leo B. Tentoni
(74) *Attorney, Agent, or Firm*—Breiner & Breiner, L.L.C.

(57) ABSTRACT

The general application of the invention is a finishing process for an air-laid nonwoven web composed of short cellulosic fibers, bound by a thermoplastic binder and having a less than perfect homogeneous fiber distribution. In the invention, the process includes deforming under hot stress the web between an undeforming hard engraved cylinder and a slave cylinder having a hardness between about 60 and 90 degrees shore hardness D. The slave cylinder is resilient and deformable at the pressure applied to it by the engraved cylinder. In particular, the invention applies to the manufacture of webs and of disposable, decorative napkins.

13 Claims, 1 Drawing Sheet

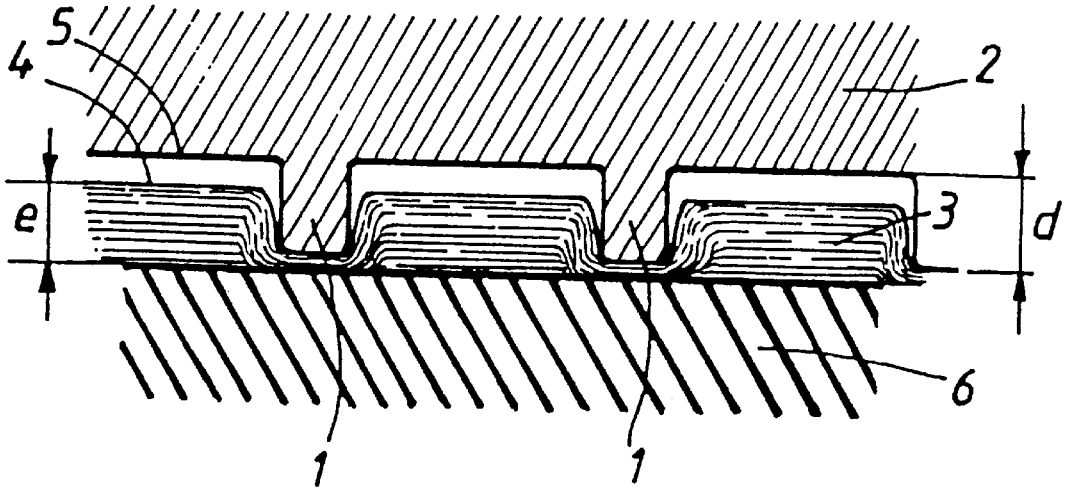
5
4
2
e
3
d
6
1
1

PROCESS OF FINISHING AN AIR-LAID WEB AND WEB OBTAINED THEREBY

This is a continuation of copending application Ser. No. 09/188,346 filed Nov. 9, 1998, now U.S. Pat. No. 6,041,701, which is a division of Ser. No. 08/756,527 filed Nov. 26, 1996, now U.S. Pat. No. 5,858,512.

FIELD OF INVENTION

The present invention concerns, on one hand, a finishing process for a dry-manufactured nonwoven or air-laid web composed of short cellulosic fibers such as wood pulp, bound by a thermoplastic binder, such as a latex or heat-fusing fibers, wherein the fiber distribution is inhomogeneous; and on the other hand, webs finished in this manner.

BACKGROUND OF INVENTION

The product of the invention includes a pattern and, following processing, is useable as a disposable sheet, (table) napkin or other decorative item.

This kind of web is manufactured by a known procedure wherein paper pulps are dry-defibered, a web is formed on a forming canvas wherein the individualized fibers are randomly distributed aeraulically, a thermoplastic binder is introduced to penetrate the web so formed to allow the fibers to interlace, followed by drying and the carrying out of crosslinking.

Where desired, a pattern can be impressed by calendering and/or embossing the web before the binding stage to thereby impart a different binder distribution. This binder then preferentially diffuses into the compacted zones.

Dry-deposited cellulose fibers are known which are composed of randomly distributed short cellulosic fibers such as wood pulp and of a thermoplastic binder, and which are provided with a pattern on at least one side of the sheet. At their surfaces, such webs include compressed and uncompressed zones. The pattern can be implemented by embossing or by -marking the sheet.

Herein, the expression "embossing" denotes creating, on part of the sheet, surface protrusions with corresponding recesses on the remaining sheet surface. In other words, an embossed sheet has gained thickness.

The expression "marking" herein denotes compressing given portions of one sheet surface by forming compacted zones and thereby reducing sheet thickness in these zones without thereby creating protrusions on the opposite side. The compressed or marked zones have higher density than the uncompressed zones. The unmarked zones may or may not be calendered.

Marking of dry-deposited sheets has been used to improve binder application to the sheets. Illustratively, in U.S. Pat. No. 4,127,637, part of the sheet surface is compressed by cylindrical rollers prior to the binding stage with the pattern then being binder stabilized. As regards U.S. Pat. No. 4,135,024, one sheet surface is marked while simultaneously a binder is applied to the other sheet surface which thereby improves binder penetration into the sheet. In this kind of procedure, web marking represents a stage within the very manufacturing process of the web.

In European Patent Document No. 0,077,005, the dry-deposited fiber web is marked to increase its bulk and to improve its absorbency. At least 40%, and preferably 50% to 80% of the total area of one sheet surface is marked. Both sides may be marked. The procedure consists in marking the dry-deposited sheet with a recess-pattern using cylinder rollers preferably lacking resilience and being heated to 140° C. to 180° C. and applying sufficient pressure to raise the density of the web portions situated underneath the compressed zones and to achieve a density of about 0.2 to 0.5 g/cm$^3$. The marking stage is carried out anytime after the dry fibers have been deposited on a moving support and after the web has been strengthened.

Nevertheless, while the absorbency in this product has been improved, it also evinces a strength, in particular rupture resistance, tending to decrease because of the shears applied to the fibers. Surface properties such as feel and velvety nature are degraded. Very likely, the marking procedure employed for this kind of product and the substantial size of the marked surface, that is of the compacted zones, are at the root of the degradation of properties. The product is harsher and less comfortable to use and, as a result, its applicability suffers in some instances, such as in use as napkins.

Moreover, being dry-manufactured, the fiber distributions of the webs are hardly uniform. Some web portions have fiber accumulations whereas others have light zones with far fewer fibers. When marking by means of an engraved steel cylinder and a slave cylinder also made of steel, there will be "super-thick" and well-marked high-density zones whereas the low-density zones are poorly marked or not marked at all. In the marked web, the high-density zones subtend "wedges" between which marking is slight. It is impossible to uniformly spread the pressure over its full generatrix. Therefore marking will be irregular. The web so marked lacks a uniform pattern and will be inferior aesthetically. This defect is present in dry-deposited webs which, in particular, have a density dispersion of ±20%.

U.S. Pat. No. 4,476,078 mentions this problem in marking following web drying and crosslinking. The description observes that in using this process, there may be neither good marking definition nor high grade pattern printing. The Patent offers as a solution a process in which the binder following its application to the web will be partially crosslinked in order to achieve a deforming and partially crosslinked sheet which is physically stable while being moved to the marking station, and during marking proper, further is marked and, lastly, completion of crosslinking of the marked sheet. Such a procedure entails drawbacks, namely, marking must be at the crosslinking station and very likely therefore at the very site of web manufacture, and the procedure per se is longer and more complex.

Most of the above prior art patents propose marking during the very manufacture of the web. As a result, severe difficulties are encountered in quickly and economically exchanging one engraved cylinder for another with a different pattern. Such procedures lack adaptability to market requirements.

OBJECTS AND BRIEF DESCRIPTION OF THE INVENTION

An object of the invention is minimization or avoidance of the above noted drawbacks by providing a web finishing process which represents simple, economic and flexible processing wherein an engraved cylinder is easily exchanged and thereby the pattern marked on the web is easily changed.

Another object of the invention is to create a marked web of which the pattern is regular regardless of the web fiber distribution while nevertheless maintaining the web's mechanical and surface properties. In particular, as regards the marked web of the invention when compared with the web before marking, the web strengths are little affected. Moreover, the deformation imparted by the engraving is permanent and this feature amounts to an inarguable advantage. Further, matte and shiny effects are provided whereby the web can evince plays of light between recesses and protrusions. The recesses, which are the compressed portions, present brilliancy. Depending on the marking associated with the calendering or not, the web thickness will decrease, or not, relative to its initial thickness.

To that end, the object of the invention is a particular process for marking an air-laid nonwoven web composed of short cellulosic fibers bound by a thermoplastic binder, such as a latex or heat-fusing fibers, and of which the fiber distribution is less than fully homogeneous, wherein a known marking technique of the conventional art to finish fabrics is used and fabric embossing is involved.

In an essential feature of the invention, the method includes hot-stress deforming of the web between an undeforming hard engraved cylinder and a slave cylinder of which the hardness is approximately between about 60 and about 90 degrees shore D, wherein the slave cylinder is resilient and deforming under the pressure applied by the engraved cylinder.

The cylinder resiliency is defined herein by the ratio of the energy restored by the cylinder following deformation to the energy that was imparted to it for deformation. This ratio can be determined from hysteresis cycles entailed by consecutive tension and relaxation using a dynamometer or by applying fly-base impact to a test bar.

In another feature of the invention, the slave cylinder is made of a deformable material, such as paper, rubber, polyamide, polyurethane or textile.

In an advantageous feature of the invention, the engraved cylinder is made of steel and is heated to a temperature ranging from about 80° C. to about 180° C., preferably about 130° C. to about 150° C.

In yet another feature of the invention, about 10% to about 40% of the cylinder's surface is engraved.

Another object of the invention is a dry-manufactured or air-laid web composed of paper fibers bound by a thermoplastic and having a less than perfect fiber distribution, evincing a formation index less than about 75 as measured in the crude state on KAJAANI apparatus and including a marked pattern on at least one of its sides.

In an important feature of the invention, the marking proportion of the web side having the marked pattern exceeds approximately 80%.

In an important feature of the web of the invention, the marked web area is less than 40% of the total surface.

Another object of the invention is a web manufactured by the process of the invention and characterized by its marked area exceeding 40% of the total surface.

Other features and advantages of the invention are elucidated in the following description and in relation to the attached drawing.

BRIEF DESCRIPTION OF THE DRAWING

The sole FIGURE is a partial view of a web compressed between a steel engraved cylinder and a resilient deforming slave cylinder wherein the web corresponds to the first type of web described hereafter.

DESCRIPTION OF PRESENTLY PREFERRED EMBODIMENTS

The problem addressed by the present invention arises because the web to be finished is composed of bound short cellulosic fibers such as wood pulp, which are distributed in other than a uniform or homogeneous manner in the web, i.e., the density varies more or less inside a given web.

Hereafter, the fiber distribution before marking and dyeing will be graded by the look-through or formation index which is an index measuring the regularity of fiber array or the evenness of fiber distribution through the sheet thickness. The physical appearance by transparency provides qualitative assessment of look-through. When the fibers are not homogeneously spread, the visual appearance of the sheet is of lighter and darker and darker zones which evoke "cloud" formation. The formation index can be measured quantitatively using optics.

To illustrate the specificity of the web of the invention, the formation index is measured as follows: light is made to pass through the sheet and the light intensity transmitted by this sheet is measured. This measurement is carried out on appropriate apparatus, herein a commercial formation analyzer called KAJAANI which is a fully automated optical device. The fiber distribution uniformity or regularity is determined by measuring the intensity of the light transmitted through a sample. The measured sample is 63.5 mm by 63.5 mm. The analyzer picks up the sample image and divides it into pixels and keeps the information in storage. Each pixel is then divided into 256 discrete gray levels. The computer then statistically calculates a histogram and the index of formation of the measured sample. The formation index varies within a scale from 20 to 122.4 wherein a higher value indicates improved, more uniform formation. The most uniform formation (measured in the absence of a sample) is 122.4.

The formation index is measured on crude webs, that is on white webs before dyeing and before marking.

The webs of the process of the invention have a formation index less than about 75.

The webs used in this process initially comprise a thickness approximately between 0.7 and 1.2 mm and an initial specific surface weight approximately between 50 and 120 $g/m^2$. For a specific surface weight of 60 $g/M^2$ for instance, a well formed web can vary by ±4 $g/m^2$.

The webs contain approximately between about 10% and about 50% by wt. of thermoplastics which allow binding of the paper fibers to one another. Generally, the binder is a latex, and in general an ethyl vinyl acetate emulsion, or heat-fusing fibers or powders.

Furthermore, these webs are already bound, that is; consolidated by the thermoplastic binder, and dried and crosslinked. The process of the invention is carried out outside the manufacture of a web per se or after it, contrary to most of the procedures of the prior art wherein marking takes place following deposition of the dry fibers and before completion of binding.

The process of the invention includes hot-stressing the web to permanently mark the decorative pattern onto at least one of its sides. The stressed deformation and heating stages can be simultaneous or apart depending on the kind of engraved cylinder utilized.

The engraved cylinder is made of a hard and undeforming material. In general, this cylinder is made of engraved steel. In that case, the steel cylinder is heated directly. However, an engraved cylinder made of another hard material also can be used, for instance, a plastic material that remains undeformed under the applied stresses and which can be engraved. In the latter case, however, heating and compression are separate in a manner already proposed for embossing textiles.

The pattern is engraved in the undeforming, hard cylinder. The cylinder surface is engraved more or less depending on the kind of desired web.

The pattern engraved in the cylinder surface includes protruding segments corresponding to the markings in the form of recesses on the web surface.

In a first kind of web, a maximum of 40% of the cylinder surface is engraved, preferably about 10% to about 40% and still more preferably about 15% to about 30%. In that case, the engraving pattern is entirely decorative. Illustratively, the design can be composed of several unit patterns, such as one or another flower, or of bold strokes or lines imparting a marbleized effect.

With respect to the FIGURE illustrating the marking of the invention for a first kind of web, the height d of the protruding part 1 of the engraved cylinder 2, i.e., the depth of the engraving, must rigorously be larger than the thickness e of the sheet or web 3 to be marked in order that the web surface 4 remain unmarked, that is undeformed by the protruding part 1 of the engraved cylinder 2 and that it be out of contact with the part 5 which does not protrude and which is heated in the usual case. As a result, the initial web thickness is not significantly affected.

As regards a second kind of web, more than 40% and preferably 60% to 90% of the cylinder surface is engraved. In that case, the pattern is much smaller and can be in the form of multiple dots. In the latter case, marking will impart an overall appearance of a textile to the web. An appearance and textile touch of the finished textile type, such as starched cotton, is desired for this kind of web, that is to give the feeling of a fabric. The object moreover is to achieve a constant thickness web which is less than the initial thickness, always for the purpose of making a product simulating a textile.

Contrary to the case for the first kind of web, the engraving depth of the second kind of web is less than the web thickness. On account of a large marked area, the web thickness is substantially reduced.

The slave cylinder, also called the matching cylinder, is made of a resilient or "elastic" material as defined above, and can undergo deformation when the engraved cylinder applies stresses. The material used in this slave cylinder must evince a hardness within the approximate interval from about 60 to about 90 degrees shore D.

Preferably, the hardness of this material is from about 65 to about 85 degrees shore D. Examples of employed materials are rubber, for instance, with an approximate shore hardness D of about 88 degrees as regards the commercial rubber Polylay, or paper with an approximate shore hardness D of about 78 to about 82 degrees, or a textile with an approximate shore hardness D of about 78 to about 85 degrees. Good results are achieved with a textile cylinder. A "composite" cylinder can be considered also, wherein the cylinder core is made of paper and the cylinder cladding is a woolen textile. The hardness of such a cylinder is about 82 degrees shore D. Polyamides also are appropriate and allow spreading stresses well over the full cylinder surface and they closely follow the pattern surface. Any equivalent elastic plastic can be considered.

As regards the second kind, textile-imitating web, illustratively, a polyurethane slave cylinder of a special grade is used evincing about 75 degrees shore D hardness.

The slave cylinder is flexible and allows web irregularities. It deforms advantageously to follow the contour of the protrusion segments of the engraved cylinder when this cylinder is pressed while hot against the web to be marked.

In one implementing mode of the invention, the web is marked while being heated between the heated steel engraved cylinder and the slave cylinder. The engraved cylinder is heated to a temperature equivalent to the softening or flow point of the web material in the compressed zone, that is to a temperature between about 80° C. and 180° C. and, preferably between about 130° C. and 150° C. The engraved cylinder applies a linear pressure on the web which can vary from about 40 to about 150 kg/cm and preferably from about 60 to about 100 kg/cm. The equipment speed can be about 10 to about 300 m/min and preferably about 80 to about 200 m/min. Be it borne in mind that temperature rises with equipment speed. As constant stress is desired, then, for a given equipment speed, the pressure and temperature of the engraved cylinder must be correlated. Preferably, a single web side will be marked, though both can be.

The web resulting from this process is marked. The marked zones are compacted and their density increased.

In general, the specific surface weight varies little relative to that of the initial web. The marked pattern is highly regular and permanent.

As regards the first kind of web, the marked web area is less than 40% of the total web surface, contrary to the case of the marked web of the procedure described in the prior art European Patent Document No. 0,077,055. Preferably, this marked area ranges from about 15% to about 30% of the total web surface. This restriction on the marked area is essential for this kind of web. Moreover, the mean thickness of the web so marked decreases only a little, about 0.02 to 0.2 mm, and preferably less than 0.1 mm, relative to the initial thickness.

In the specific marking procedure of the invention, and for the special case of the marked area being less than 40% of the total surface and of the engraving depth being larger than the sheet thickness, the web advantageously retains its pre-marking properties, such as its soft feel and velvety nature. The web so marked offers greater softness than those conventionally marked.

One of the essential features of the marked webs of the invention, and in particular those of the first kind, is that despite the non-uniformity of web fiber distribution evidenced by look-through, it does offer a permanent pattern.

This feature can be quantified by measuring the web's marking rate. The marking rate corresponds to the transfer efficiency of the engraved cylinder image to the web. This transfer rate was measured on apparatus know commercially as QUANTIMET 600 made by Leica.

The analysis involves subjecting web samples to grazing illumination at given angles to find pattern protrusions by creating zones of shadows. The area of the shadow zones is measured by starting from a threshold of gray based on a control.

The marking rate is the following ratio: marked web area (relative to total web surface) to the theoretical marked area (corresponding to the engraved cylinder surface relative to the total web surface.

A marking rate of 0 denotes an unmarked surface and a marking rate of 100 denotes ideal marking. In fact, the marking rate of 100 is the perfect impression of the engraved cylinder protrusion.

The marked web of the invention corresponding to the first kind of web, namely the web of which the marked area is less than 40%, evinces a marking rate exceeding approximately 80% and preferably 90%.

The aesthetics of such a web are considerably improved relative to a conventionally marked web passing through two steel cylinders and evincing an irregular and impermanent pattern.

Another advantageous feature of the first kind of web is that it offers glossy surface zones alternating with matte surface zones well visible to the naked eye, wherein the glossy zones correspond to the marked area of the web. This matte and glossy effect emphasizes the pattern and contributes to web finishing. The effect imparts a satiny appearance to the marked area and suggests damask cotton as regards feel and appearance.

As regards the second kind of web, the marked area exceeds 40% of the total web surface. The web thickness is less than its initial thickness. The decrease in thickness is roughly 25% of the initial one. This web furthermore offers the advantage of constant thickness, which is not necessarily the case for the just manufactured initial web.

In this kind of web, which has a textile appearance, rigidity can be advantageously increased, for instance in such a manner that the napkins are endowed with the feel of a finished textile and once folded for appearance retain the folded form. This purpose is achieved by increasing the specific surface weight of the web and by selecting an appropriate binder.

Lastly, regardless of its marked area, the marked web of the invention evinces mechanical properties, in particular strength, which are substantially the same as those of the web before being processed.

As will be apparent to one skilled in the art, various modifications can be made within the scope of the aforesaid description. Such modifications being within the ability of one skilled in the art form a part of the present invention and are embraced by the appended claims.

It is claimed:

1. Finishing process for an air-laid non-woven web composed of short cellulosic fibers bound by a thermoplastic binder and having a fiber distribution which is less than homogeneous comprising deforming under hot-stress said web between an undeforming hard engraved cylinder and a slave cylinder constructed and arranged to have a hardness between about 60 and about 90 degrees shore hardness D, and wherein said slave cylinder resilient and deformable under pressure applied by said engraving cylinder.

2. Process as claimed in claim 1 wherein said slave cylinder has a hardness between about 65 and about 90 degrees shore hardness D.

3. Process as claimed in claim 1 or claim 2 wherein the slave cylinder is made of a deformable material.

4. Process as claimed in claim 3 wherein said deformable material is selected from a group consisting of paper, rubber, polyamide, polyurethane and textile.

5. Process as claimed in claim 1 wherein the hard engraved cylinder is made of steel or of any other undeforming material at the applied pressure.

6. Process as claimed in claim 5 wherein the hard engraved cylinder is made of steel and is heated to a temperature in a, range of from about 80° C. to about 180° C.

7. Process as claimed in claim 6 wherein said temperature is in a range of from about 130° C. to about 150° C.

8. Process as claimed in claim 1 wherein linear pressure applied by the engraved cylinder is from about 40 to about 150 kg/cm.

9. Process as claimed in claim 8 wherein the linear pressure is from about 60 to about 100 kg/cm.

10. Process as claimed in claim 1 further comprising calendering which is carried out simultaneously with marking.

11. Process as claimed in claim 1 wherein the engraved, cylinder has an exterior surface which is from about 10% to about 40% engraved.

12. Process as claimed in claim 11 wherein said exterior surface is from about 15% to about 30% engraved.

13. Process as claimed in either of claim 11 or claim 12 wherein depth of engraving on said exterior surface exceeds thickness of the web.

* * * * *

UNITED STATES PATENT AND TRADEMARK OFFICE

CERTIFICATE OF CORRECTION

PATENT NO. : 6,332,996 B1
DATED : December 25, 2001
INVENTOR(S) : Bernard Louis Dit Picard et al.

It is certified that error appears in the above-identified patent and that said Letters Patent is hereby corrected as shown below:

Column 1,
Line 40, "-marking" should read -- marking --.

Column 4,
Line 40, "60 g/M$^{2}$" should read -- 60 g/m$^{2}$ --.
Line 47, "that is;" should read -- that is, --.

Column 6,
Line 54, "(corresponding to the engraved cylinder surface" should read -- (corresponding to the engraved cylinder surface) --.

Column 8,
Line 2, after the word "cylinder" insert -- is --.
Line 17, "a, range" should read -- a range --.

Signed and Sealed this

Twelfth Day of March, 2002

*Attest:*

*Attesting Officer*

JAMES E. ROGAN
*Director of the United States Patent and Trademark Office*